US011177575B2

(12) United States Patent
Yang

(10) Patent No.: US 11,177,575 B2
(45) Date of Patent: Nov. 16, 2021

(54) PLANAR ANTENNA ELEMENT AND ANTENNA

(71) Applicant: SHENZHEN ANTOP TECHNOLOGY CO., LTD., Guangdong (CN)

(72) Inventor: Ruidian Yang, Guangdong (CN)

(73) Assignee: SHENZHEN ANTOP TECHNOLOGY CO. LTD., Guangdong (CN)

( * ) Notice: Subject to any disclaimer, the term of this patent is extended or adjusted under 35 U.S.C. 154(b) by 61 days.

(21) Appl. No.: 16/714,464

(22) Filed: Dec. 13, 2019

(65) Prior Publication Data

US 2021/0098880 A1 Apr. 1, 2021

(30) Foreign Application Priority Data

Sep. 27, 2019 (CN) ..... 201921628338.6

(51) Int. Cl.
*H01Q 19/10* (2006.01)
*H01Q 9/04* (2006.01)
*H01Q 15/14* (2006.01)

(52) U.S. Cl.
CPC ..... *H01Q 9/045* (2013.01); *H01Q 15/14* (2013.01)

(58) Field of Classification Search
CPC ..... H01Q 9/045; H01Q 15/14
See application file for complete search history.

(56) References Cited

U.S. PATENT DOCUMENTS 4,924,236 A * 5/1990 Schuss ..... H01Q 9/0442 343/700 MS
2021/0091461 A1* 3/2021 Howarth ..... H01Q 13/18

FOREIGN PATENT DOCUMENTS

CN 202749505 U 2/2013
JP 2008048005 A * 2/2008
JP 2012124864 A * 6/2012

* cited by examiner

*Primary Examiner* — Dieu Hien T Duong
(74) *Attorney, Agent, or Firm* — Muncy, Geissler, Olds & Lowe, P.C.

(57) ABSTRACT

The invention relates to a planar antenna element and an antenna. The planar antenna element includes a main radiator and secondary radiators. The main radiator is a rectangular metal sheet in which a double gourd-shaped opening is formed. The double gourd-shaped opening includes a first opening, a second opening and a feed line part. The first opening and the second opening are communicated through the feed line part and are symmetrical to each other. The secondary radiators are arranged on the short sides of the main radiator.

9 Claims, 1 Drawing Sheet

PLANAR ANTENNA ELEMENT AND ANTENNA

TECHNICAL FIELD

The present invention relates to the technical field of antennas, and specifically relates to a planar antenna element and an antenna.

BACKGROUND ART

At present, a planar antenna has element type, slot type and other types, and is commonly characterized by being small in volume, light in weight, small in wind resistance and convenient to install and use. A built-in tuner integrates the antenna with the tuner to facilitate the adjustment. The planar antenna is high in efficiency, and is especially suitable for the reception of live satellite television. With the popularization of wireless digital television signals, more and more people receive television signals outdoors or on the move rather than being limited indoors. Even when watching television indoors, the antennas are needed to be installed at different positions in many environments. At this time, higher requirements are placed on the antennas which are tasked with signal reception: wide receiving frequency range, small occupied space, lightweight, being able to be installed in various environments and resistant to various weather, and strong signal receiving capabilities and the like.

However, it is still difficult for the existing planar antennas to achieve a breakthrough in expanding the frequency bandwidth. The key is that the impedance of the element does not adapt to the cable, thereby causing a loss situation in the signal transmission process and problems of unstable signal reception in the UHF band and failing to cover the UHF band.

SUMMARY

The present invention aims to overcome at least one defect (deficiency) of the above prior art and to solve a problem that the planar antenna element receives signals unstably in the UHF band.

The planar antenna element according to the present invention includes a main radiator and secondary radiators. The main radiator is a rectangular metal sheet in which a double gourd-shaped opening is formed. The double gourd-shaped opening includes a first opening, a second opening and a feed line part. The first opening and the second opening are communicated through the feed line part and are symmetrical to each other. The secondary radiators are arranged on the short sides of the main radiator.

The impedance of the planar antenna element can be adjusted by the shape and size of the double gourd-shaped opening so as to be adapted to the coaxial cable connected to the feed hole, match the impedance of the cable, and reduce the reflection loss effect in the signal transmission process. The frequency range of the planar antenna element is from 470 MHz to 860 MHz which matches the UHF band. Meanwhile, combined with the arrangement of the secondary radiators, the antenna element is lengthened within a limited length, thereby enhancing the signal reception of the planar antenna element on 470 to 550 MHz band and improving the stability of the signal reception.

Preferably, the secondary radiators include four L-shaped radiators each of which extending outwardly from the four ends of the short sides respectively and bending and extending toward the central axis of the short side to form an L-shaped structure. The structure saves material while increasing the length, so that the length of the planar antenna element increases without becoming thick and heavy.

Preferably, the L-shaped radiators are bent and arranged at a preset angle relative to the main radiator, and the preset angle is 30 to 90 degrees so as to realize the miniaturization of the planar antenna element.

Preferably, the first opening is provided with a constricted portion which has a trapezoidal structure. Two oblique sides of the trapezoidal structure are not equal in length, and the oblique side near the feed line part is shorter. The oblique side, away from the feed line part, in the trapezoidal structure is parallel to the oblique side, connected to the feed line part, of the first opening.

The preferred scheme at the first opening is also applicable to the preferred scheme of the second opening since the symmetrical structure between the first opening and the second opening, and the preferred schemes of the two openings should be performed simultaneously. The planar antenna element can better transmit signals by adjustments through the shapes and sizes of the first opening and the second opening, so that the stability of signal reception is improved.

Preferably, the feed line part has a stepped structure. The design of the feed line part can reduce distance to change the capacitance value so as to influence the standing wave of the element, enable the planar antenna element to receive signals more effectively, and prevent short circuit from happening when a signal line is welded.

Preferably, upper tangent lines of the double gourd-shaped opening are parallel to the long sides of the main radiator.

Preferably, the main radiator is provided with positioning holes for better installation of the planar antenna element in the antenna box.

Preferably, the main radiator has a thickness of 0.4±0.05 mm, and the main radiator is much lighter and thinner relative to other antenna elements.

An antenna includes a reflection plate, a radiator arranged on the reflection plate and a feeding line fed for the radiator, in which the radiator includes the above-described planar antenna element.

Compared with the prior art, the present invention can obtain some beneficial effects. The planar antenna element and the antenna in the present invention are simple in structure, convenient to produce and install, high in signal reception quality, wide in signal coverage, and can effectively cover the UHF band for more stable signals in the UHF band.

DESCRIPTION OF EMBODIMENTS

Figure 1:
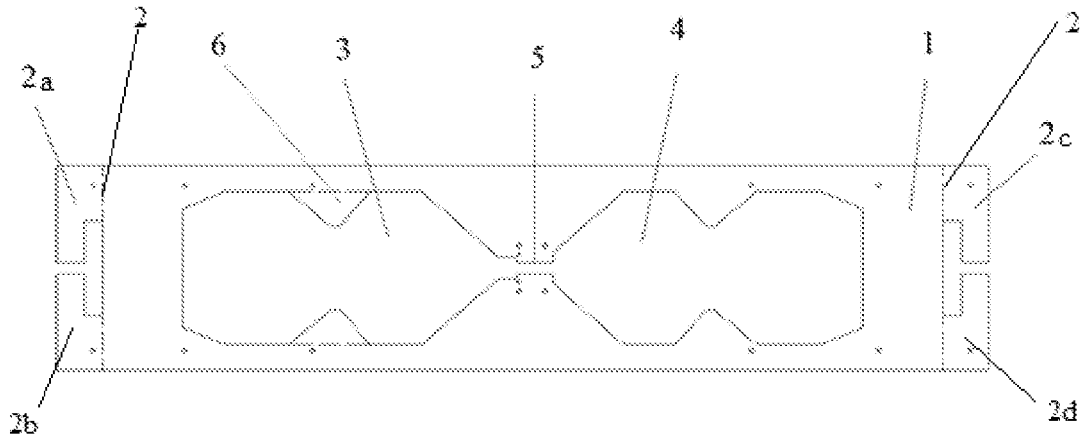
FIG. 1 is a structural schematic diagram of a planar antenna element of the present invention.

The drawings of the present invention are for illustrative purposes only and are not to be construed as limiting the present invention. In order to better illustrate the following embodiments, certain components of the drawings may be omitted, enlarged, or reduced, and do not represent the dimensions of the actual product. It will be understood that some known structures and descriptions thereof in the drawings may be omitted for those skilled in the art.

As shown in FIG. 1, the present embodiment is a planar antenna element including a main radiator 1 and secondary radiators 2. The main radiator 1 is a rectangular metal sheet in which a double gourd-shaped opening is formed. The double gourd-shaped opening includes a first opening 3, a second opening 4 and a feed line part 5. The first opening 3 and the second opening 4 are communicated through the feed line part 5 and are symmetrical to each other. The secondary radiators 5 are arranged on the short sides of the main radiator 1.

Figure 2:
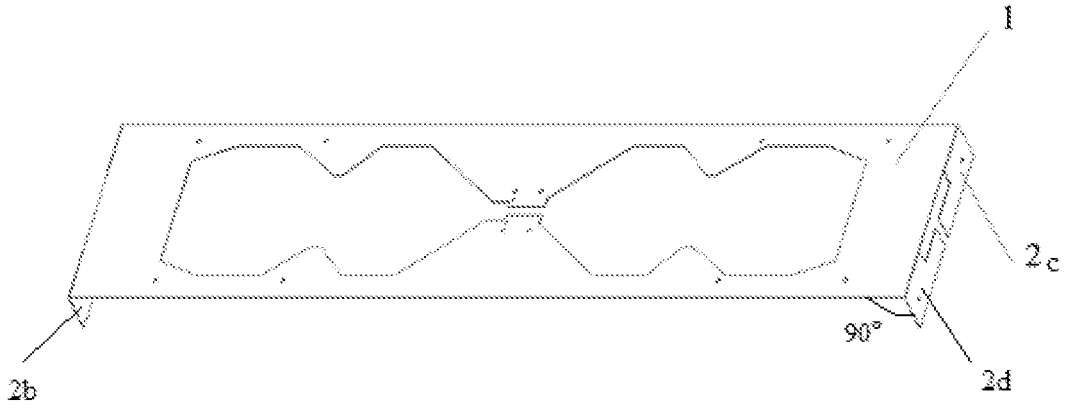
FIG. 2 is a perspective view of the planar antenna element of the present invention.

Preferably, as shown in FIG. 1, the secondary radiators 2 include four L-shaped radiators 2*a*, 2*b*, 2*c* and 2*d* each of which extending outwardly from the four ends of the short sides respectively and bending and extending toward the central axis of the short side to form an L-shaped structure. The L-shaped radiators 2*a* to 2*d* are used to enhance signals in the range of 470 to 520 MHz, and increase the size of the planar antenna element within a limited length. Preferably, as shown in FIG. 2, the L-shaped radiators 2*a* to 2*d* are bent relative to the main radiator 1 and have a bending angle of 90°, which satisfies the size requirements of the planar antenna element and realizes miniaturization.

Preferably, as shown in FIG. 1, a constricted portion 6 of a trapezoidal structure is respectively provided in the long-side direction of the first opening 3. Two oblique sides of the trapezoidal structure are not equal in length, and the oblique side near the feed line part 5 is shorter. The oblique side away from the feed line part 5 is parallel to the oblique side, connected to the feed line part 5, of the first opening 3. The preferred scheme at the first opening 3 is also applicable to the preferred scheme of the second opening 4 since the symmetrical structure between the first opening 3 and the second opening 4, and the preferred schemes of the two openings should be performed simultaneously.

Figure 3:
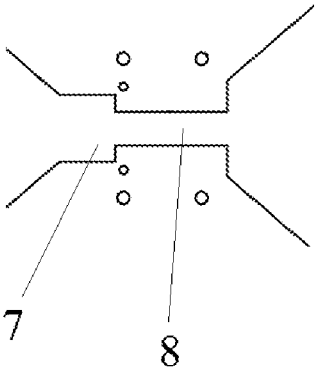
FIG. 3 is a structural schematic diagram of a feed line part of the present invention.

Preferably, as shown in FIG. 3, the feed line part has a stepped structure and includes a first step 7 and a second step 8. The design of the feed line part can change the capacitance value so as to influence the standing wave, enable the planar antenna element to receive signals more effectively. The stepped design prevents short circuit from happening when a feed line is welded.

Preferably, as shown in FIG. 1, the upper tangent lines and the lower tangent lines of the double gourd-shaped opening are parallel to the long sides of the main radiator 1.

Preferably, as shown in FIG. 1, the main radiator 1 and the L-shaped radiators 2*a* to 2*d* are all provided with positioning holes for better installation of the planar antenna element in the antenna box.

Preferably, the main radiator adopts a galvanized iron sheet with a thickness of 0.4±0.05 mm.

Obviously, the above embodiments of the present invention are merely examples for clear illustration of the invention, and are not intended to limit the implementation of the invention. Any modification, equivalent substitution or improvement and the like within the spirit and principle of the claims of the present invention should be included in the scope of claims of the present invention.

The invention claimed is:

1. A planar antenna element, comprising: a main radiator and secondary radiators, wherein the main radiator is a rectangular metal sheet in which a double gourd-shaped opening is formed, the double gourd-shaped opening includes a first opening, a second opening and a feed line part, the first opening and the second opening are communicated through the feed line part and are symmetrical to each other, and the secondary radiators are arranged on short sides of the main radiator, wherein the secondary radiators include four L-shaped radiators each of which extending outwardly from four ends of the short sides respectively and bending and extending toward a central axis of a short side to form an L-shaped structure.

2. The planar antenna element according to claim 1, wherein the L-shaped radiators are bent and arranged at a preset angle relative to the main radiator.

3. The planar antenna element according to claim 1, wherein the first opening is provided with a constricted portion.

4. The planar antenna element according to claim 3, wherein the constricted portion has a trapezoidal structure, two oblique sides of the trapezoidal structure are not equal in length, and an oblique side near the feed line part is shorter.

5. The planar antenna element according to claim 4, wherein the oblique side, away from the feed line part, in the trapezoidal structure is parallel to the oblique side, connected to the feed line part, of the first opening.

6. The planar antenna element according to claim 1, wherein the feed line part has a stepped structure.

7. The planar antenna element according to claim 1, wherein upper tangent lines of the double gourd-shaped opening are parallel to long sides of the main radiator.

8. The planar antenna element according to claim 1, wherein the main radiator has a thickness of 0.4±0.05 mm.

9. An antenna, comprising: a reflection plate, a radiator arranged on the reflection plate, and a feeding line fed for the radiator, wherein the radiator includes a planar antenna element according to claim 1.

* * * * *